US006084191A

United States Patent [19]

Kataya et al.

[11] Patent Number: 6,084,191

[45] Date of Patent: Jul. 4, 2000

[54] CIRCUIT BREAKER

[75] Inventors: Ryuji Kataya, Osaka; Shozo Kaneko, Izumi, both of Japan

[73] Assignees: Terasaki Denki Sangyo Kabushiki Kaisha, Osaka, Japan; Moeller GmbH, Bonn, Germany

[21] Appl. No.: 09/362,664

[22] Filed: Jul. 29, 1999

[30] Foreign Application Priority Data

Aug. 7, 1998 [JP] Japan ..... 10-224279

[51] Int. Cl.[7] ..... H01H 9/00

[52] U.S. Cl. ..... 200/401; 200/400; 335/172

[58] Field of Search ..... 218/22, 154; 335/172–176; 200/17 R, 400, 401, 500, 501, 318, 323, 324, 325

[56] References Cited

U.S. PATENT DOCUMENTS

| | | | |
|---|---|---|---|
| 4,368,444 | 1/1983 | Pruess et al. | 335/166 |
| 4,546,224 | 10/1985 | Mostosi | 200/153 G |
| 4,710,738 | 12/1987 | Neel et al. | 335/172 |
| 5,213,206 | 5/1993 | Beck et al. | 200/401 |
| 5,290,982 | 3/1994 | Beck et al. | 200/401 |
| 5,466,903 | 11/1995 | Faber et al. | 200/400 |
| 5,543,595 | 8/1996 | Mader et al. | 200/401 |

FOREIGN PATENT DOCUMENTS

| | | | |
|---|---|---|---|
| 58-201221 | 11/1983 | Japan | H01H 73/56 |
| 58-201222 | 11/1983 | Japan | H01H 73/36 |
| 58-201223 | 11/1983 | Japan | H01H 73/36 |
| 6-84443 | 3/1994 | Japan | H01H 73/12 |
| 8-36963 | 2/1996 | Japan | H01H 71/64 |

*Primary Examiner*—Michael Friedhofer
*Attorney, Agent, or Firm*—McDermott, Will & Emery

[57] ABSTRACT

In a circuit breaker utilizing a toggle link mechanism, the reset operation is facilitated. A block link including a reset pin, a first hole and a second hole is provided. The reset pin is inserted into a circular arc shape third hole formed concentric with the rotation of a trip lever formed at a secured frame. An actuating pin of a handle lever is inserted into the first hole. A shaft provided at a movable contact holder is inserted into the second hole. By this mechanism, the friction in the reset operation can be reduced to allow the reset operation to be perform by a smaller force. As a result, an auxiliary handle is not required. The handle and electrical operation devices can be reduced in size. Also, the operating handle is prevented from moving to the OFF position when the switching contacts are welded.

8 Claims, 9 Drawing Sheets

WELDED

CIRCUIT BREAKER

BACKGROUND OF THE INVENTION

1. Field of the Invention

The present invention relates to a circuit breaker of a structure having the operating handle prevented from moving to the OFF position when the switching contacts are welded and facilitating the reset operation.

2. Description of the Background Art

The basic structure of a circuit breaker that will be described in detail afterwards with reference to the embodiment of the present invention is mainly constituted by switching contacts, a movable contact device with a movable contact of the switching contacts, a handle lever and a trip lever attached pivotally to a secured frame, a toggle link mechanism coupled between the trip lever and the movable contact device, an operating spring provided between the connecting pin of the toggle link and the handle lever, a latch device to latch the rotation of the trip lever by the operating spring, an overcurrent tripping device releasing the latch of the latch device to open the switching contacts when overcurrent flows, a reset means to reset the latch device released in its latch, a casing of molded insulator to enclose the above members, and an operating handle protruding from the casing.

The ON operation of this circuit breaker is performed by rotating the operating handle attached to the handle lever in the ON direction. This rotation causes the operating spring to extend. When the acting line of force of the operating spring crosses the connecting point of the trip lever and the toggle link mechanism, the bending toggle link mechanism is straightened, whereby the movable contact device operates. As a result, the switching contacts form contact. The OFF operation is performed by rotating the operating handle in the OFF direction. This rotation causes the operating spring to extend. When the acting line of force of the operating spring crosses the connecting point between the trip lever and the toggle link mechanism, the toggle link mechanism taking a straightened posture is bent, whereby the movable contact device operates to open the switching contacts.

In a trip operation when the overcurrent tripping device operates in an ON state, the latch of the latch device is released. The trip lever rotates, whereby the connecting point between the trip lever and the toggle link mechanism moves. When the acting line of force of the operating spring relatively crosses this connecting point, the toggle link mechanism taking a straightened posture is bent, whereby the switching contacts open. Here, the handle lever is rotated to a position intermediate the ON position and the OFF position. In order to close the switching contacts of the circuit breaker subjected to a trip operation again, the handle lever is moved towards the OFF position to perform a reset operation of turning the trip lever that co-acts with the handle lever to the direction where the latch means attains an engaging state again. By this operation, the operating handle passes the reset position to return to the OFF position. Subsequently, the switching contacts can be brought into contact by effecting an ON operation as described above.

Since the circuit breaker can have the operating handle move to the ON position, the OFF position, and a trip position intermediate therebetween, discrimination can be made whether the switching contacts are in contact or not by the position of the handle.

However, once the switching contacts are welded, the switching contacts will not open even if the operating handle is moved to the OFF position, resulting in a charging state of the load side of the electric circuit. This means that the electric circuit of the load side is in a charging state even when confirmation is made that the handle is located at the OFF position. There is a danger that the service and maintenance task may be being carried out in a charging state.

In view of the above problem, several circuit breakers have been disclosed (Japanese Patent Laying-Open Nos. 58-201221, 58-201222, and 58-201223). In brief, this conventional art is directed to a circuit breaker that, when an attempt is made to move the operating handle towards the OFF position in the event of the switching contacts being welded, the handle lever engages directly with the movable contact device at an intermediate position during its shift to the OFF position to prevent any further movement.

The problem related to the aforementioned danger is solved in these conventional circuit breakers. However, it is to be noted that in the reset operation of rendering the latch device released in its latch by a trip operation to an engaging state again in the conventional circuit breaker, the trip lever is rotated in the reset direction while the reset member fixed at the handle lever slides along the engaging end of the trip lever. Consequently, a bigger operating force is required in the reset operation due to the friction generated by the slide

SUMMARY OF THE INVENTION

An object of the present invention is to provide a circuit breaker that allows the reset operation to be performed easily.

Another object of the present invention is to provide a circuit breaker that has the operating handle prevented from moving to the OFF position when the switching contacts are welded.

A further object of the present invention is to provide a circuit breaker whose welded contacts can be removed, when not firmly welded. More specifically, when the operating handle was able to be rotated up to the OFF position, the weld had been removed during the rotation.

According to an aspect of the present invention, a circuit breaker includes a movable contact device pivotally provided with a movable contact holder pivotally holding a movable contact arm having one contact of a pair of switching contacts that can open/close, a handle lever and trip lever pivotally provided at a secured frame, an operating handle to operate the handle lever, a pair of links coupled by a connecting pin between the trip lever and the movable contact device, an operating spring provided between the connecting pin and the handle lever, a latch device latching the rotation of the trip lever that is biased by the operating spring, and reset means resetting the latch device released in its latch by rotating the handle lever. The circuit breaker has the operating spring extended to straighten the pair of links, whereby the switching contacts are brought into contact when the handle lever is rotated in the ON direction. The reset means includes a reset driving member that rotates the trip lever, guide means guiding the movement of the reset driving member, and a reset link coupling the reset driving member and the handle lever.

According to the above structure, the handle lever and the reset driving member are coupled via the reset link. Therefore, the reset driving member is freed from the constraint of moving on a circular arc that is concentric with the center of rotation of the handle lever. That is, the reset driving member can be driven in an arbitrary trajectory, guided by the guide means provided to facilitate the rotation of the trip lever.

According to another aspect of the present invention, the circuit breaker of the above aspect has the guide means formed along a circular arc concentric with the center of rotation of the trip lever. Since the handle lever can be rotated without the reset driving member sliding along the engaging edge, the friction is small. Therefore the reset operation can be performed by a smaller force.

According to a further aspect of the present invention, the circuit breaker of the above aspect has a guide groove formed at the secured frame as the guide means, and a reset pin fitted in the guide groove as the driving member. The reset link has one end holding the reset pin and the other end coupled to the handle lever by an actuating pin provided at one of the reset link and the handle lever and a hole provided at the other of the reset link and the handle lever into which the actuating pin is fitted.

According to still another aspect of the present invention, the circuit breaker of the above aspect includes engaging means for the reset link to engage with the movable contact device at an intermediate position of the passage of the operating handle to the OFF position when the handle lever is rotated towards the OFF position in the state where the switching contacts are welded. When the reset link is engaged with the movable contact device, the guide means obstructs the movement of the reset driving member, whereby any further rotation of the operating handle is prevented.

At the intermediate position of the operating handle in its passage to the OFF position when the handle lever is operated under the welded state, the reset link engages with the movable contact device that will not rotate by the weld, and the reset driving member has its movement obstructed by the guide means. Therefore, the handle lever cannot be rotated any further.

In the above circuit breaker including the engaging means of the reset link and the movable contact device, the engaging means is desirably a projection provided at one of the reset link and the movable contact device and an engaging edge provided at the other of the reset link and the movable contact device.

In the above circuit breaker employing a projection and an engaging edge as the engaging means, the shaft that couples the movable contact device and one of the pair of links is used as the projection provided at the movable contact device. Therefore, a particular member is not additionally required for this structure.

In the circuit breaker provided with engaging means of the reset link and the movable contact device, and having the guide means obstructing movement of the reset driving member to prevent further rotation of the operating handle when the engaging means establishes engagement, engagement is established between the reset link and the movable contact device at an angle in which the operating force of rotating the handle lever in the OFF direction at the engaging point between the reset link and the movable contact device pushes the movable contact device in a direction that causes the weld to be removed. Therefore, the weld, if not fixed firmly, is removed. In other words, the engagement is set so that the weld is removed during rotation of the operating handle when the operating handle can arrive at the OFF position.

According to a still further aspect of the present invention, the actuating pin and the hole that couple the reset link with the handle lever are fitted loosely to each other. In the normal state in which the switching contacts are not welded, the reset link can move in a more free state in the ON operation, OFF operation, or trip operation that does not require the reset link. Therefore, the reset link will not adversely affect the manipulation or the operation.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to FIGS. 1–8.

Figure 1:
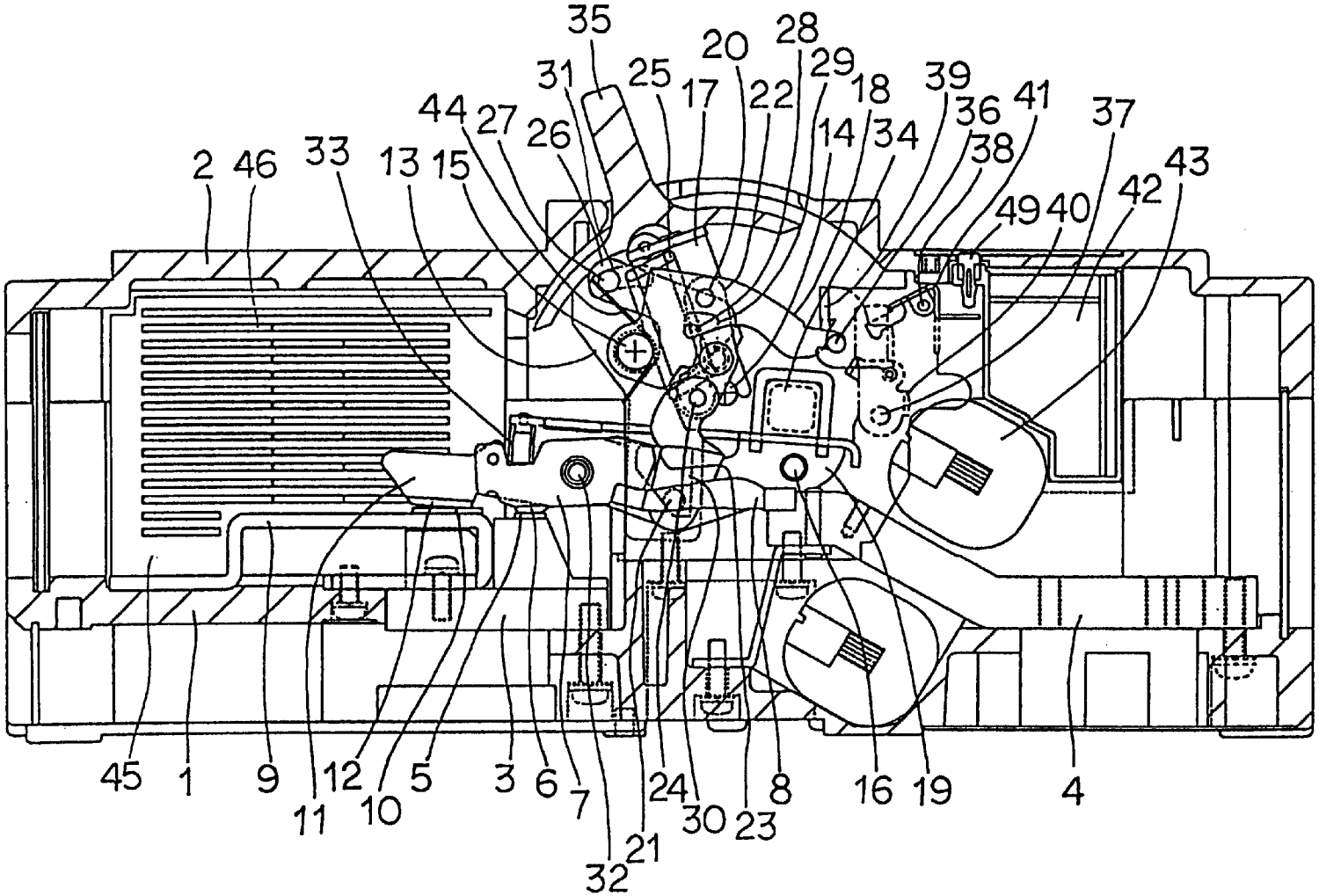
FIG. 1 is a side sectional view of an entire circuit breaker in an ON state according to an embodiment of the present invention.

Referring to FIG. 1, a multipole circuit breaker of the present embodiment in an ON state includes a conductor unit with switching contacts, an operating mechanism closing and opening the switching contacts, an overcurrent tripping device, and an arc extinguishing device that extinguishes an arc generated when the current is cut off, all enclosed in a casing formed of a base 1 and a cover 2 of an insulating molding.

The conductor unit includes a stationary contact base 3 and a stationary conductor 4 connected with a terminal plate, a stationary contact 5 of stationary contact base 3, a movable contact arm 7 with a movable contact 6 to open and close with stationary contact 5, and a flexible conductor 8 connecting stationary conductor 4 and movable contact arm 7. The conductor unit also includes a stationary arc contact base 9 attached to stationary contact base 3, a stationary arc contact 10 provided at stationary arc contact base 9, a movable arc contact arm 11 provided in parallel with movable contact arm 7, a movable arc contact 12 provided at movable arc contact arm 11 to open and close with stationary arc contact 10, and a flexible conductor provided in parallel with flexible conductor 8 to connect movable arc contact arm 11 and stationary conductor 4.

The operating mechanism includes a secured frame 13 attached to base 1, a handle lever 17, a trip lever 18 and a movable contact holder 19 pivotably supported by shafts 14, 15 and 16, respectively, of secured frame 13, first and second links 22 and 23 pivotably supported by a shaft 20 of trip lever 18 and a shaft 21 of movable contact holder 19, respectively, a connecting pin 24 pivotally coupling first and second links 22 and 23, a tension coil spring 25 attached between handle lever 17 and connecting pin 24, and a block link 26 functioning as a reset link.

Block link 26 includes a reset pin 27, and first and second holes 29 and 30 of substantially a right triangle. An actuating pin 28 of handle lever 17 is inserted in first hole 29. Shaft 21 of movable contact holder 19 is inserted in second hole 30. Pin 27 is inserted into a third hole 31 of an arc shape about a shaft 15 formed at secured frame 13. Block link 26 is biased substantially rightwards by a torsion spring 44 of a weak action force to be urged against a member to prevent generation of noise caused by vibration with another component when in a free state.

Movable contact holder 19 includes a shaft 32 holding movable contact arm 7 and movable arc contact arm 11 pivotally, a contact pressure spring 33 provided to bias movable contact arm 7 and movable arc contact arm 11 counterclockwise respectively, and a cross bar 34 to establish cooperation between a center pole and another pole.

The operating mechanism further includes an operating handle 35 attached to handle lever 17 and protruding upwards from an opening in cover 2, and a latch mechanism preventing rotation of trip lever 18 in the counterclockwise direction. The latch mechanism includes a primary hook 39, a secondary hook 40 and a trip piece 41 pivotably supported by shafts 36, 37 and 38, respectively, of secured frame 13, and biased counterclockwise by a return spring not shown.

Overcurrent tripping device 42 senses the output of a current transformer 43 arranged in the proximity of stationary conductor 4 to generate a trip signal at a predetermined condition. The arc extinguishing device includes a plurality of magnetic material plates 46 held by an insulation plate 45 that attracts and cools the arc generated when the switching contacts open.

The above circuit breaker has a structure similar to that of a conventional circuit breaker except for block link 26 and any relating member thereof. The ON and OFF operation, trip operation, and reset operation will be described with reference to FIGS. 2–6 corresponding to respective main components of FIG. 1.

Figure 2:
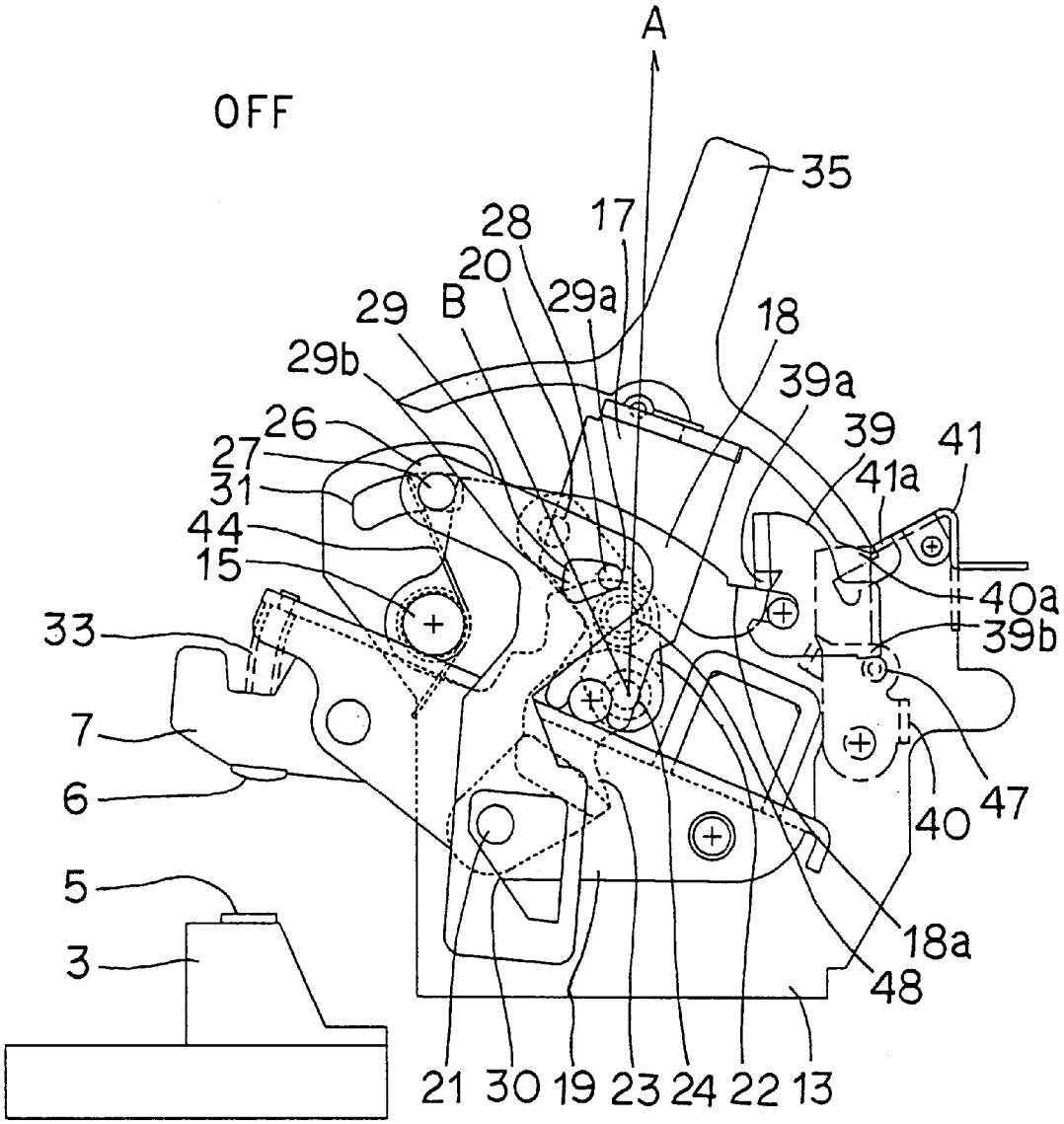
FIG. 2 is a side view of the main part of the circuit breaker of FIG. 1 in an OFF state.
Figure 3:
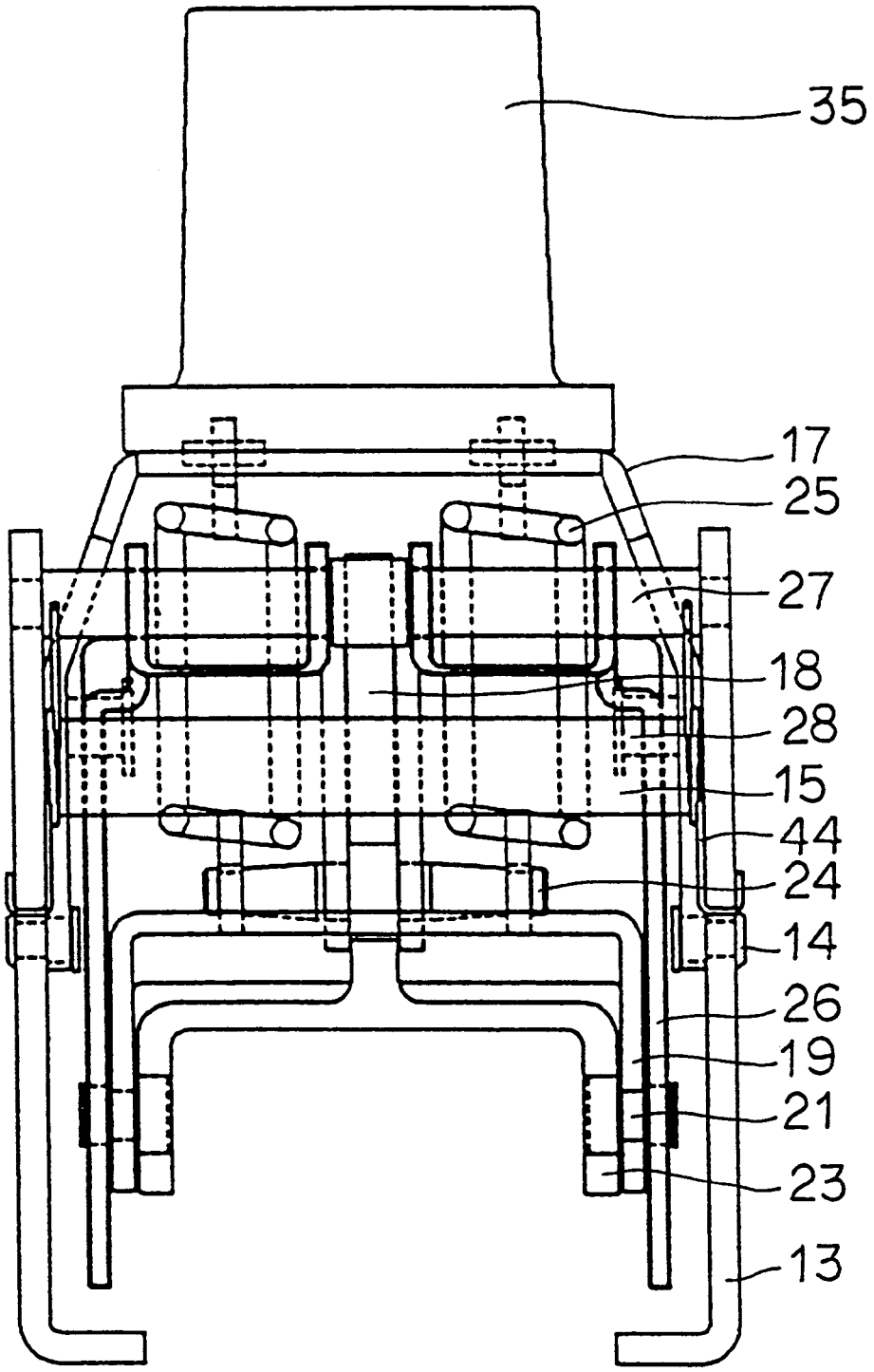
FIG. 3 shows the main part of the operating mechanism in the circuit breaker of FIG. 2 viewed from the left side.

In the circuit breaker of the present embodiment in an OFF state shown in FIGS. 2 and 3, connecting pin 24 is biased in the direction of the acting line of force A of tension coil spring 25 (not shown in FIG. 2). In response, trip lever 18 is biased counterclockwise via first link 22. An engaging end 18*a* of trip lever 18 engages with an engaging end 39*a* of primary hook 39, whereby primary hook 39 is pushed clockwise. An engaging end 39*b* of primary hook 39 engages with a roller 47 of secondary hook 40, whereby secondary hook 40 is pushed clockwise to establish engagement between an engaging end 40*a* and an engaging end 41*a* of trip piece 41. Although trip piece 41 is pushed counterclockwise, rotation thereof is obstructed by a stopper device not shown. By obstruction of the rotation of trip piece 41, secondary hook 40, primary hook 39 and trip lever 18 are prevented from rotation.

The bias of connecting pin 24 in the direction of A causes movable contact holder 19 to rotate clockwise, whereby the upper surface is brought into contact with shaft 15 to be suppressed in rotation. Movable contact arm 7 has its counterclockwise rotation obstructed by the stopper device. An open state is established between stationary contact 5 and movable contact 6.

In this state, bias is applied towards handle lever 17 in the clockwise. However, since actuating pin 28 urges engaging end 29*a* of first hole 29 to move block link 26 rightwards and reset pin 27 is in contact with trip lever 18, the further movement of block link 26 and rotation of handle lever 17 are both obstructed. Here, operating handle 35 is at the OFF position. In this state, shaft 21 does not form contact with the inner edge of second hole 30.

Figure 4:
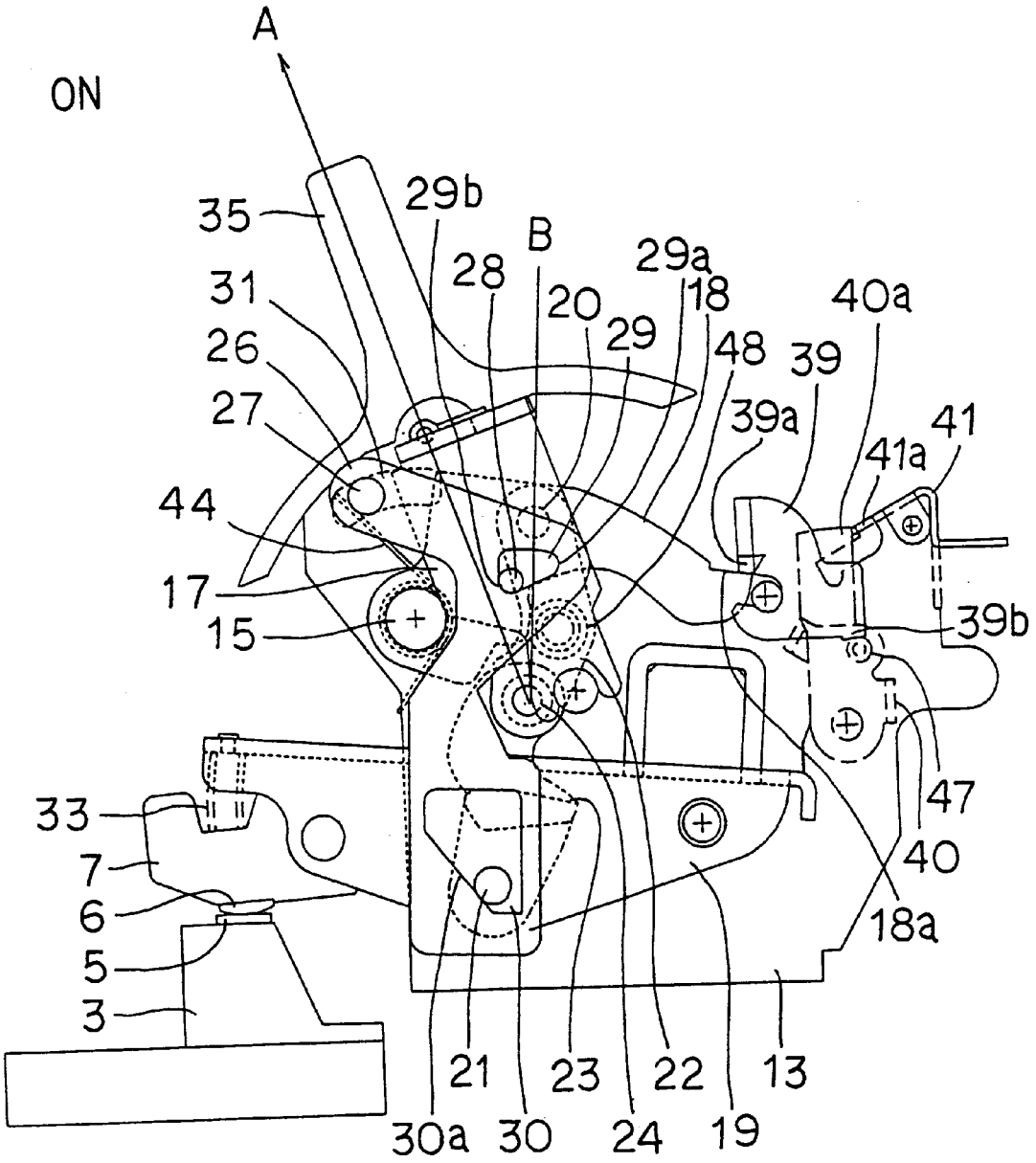
FIG. 4 is a side view of the main part of the circuit breaker of FIG. 1 in an ON state.

The ON operation is performed by rotating operating handle 35 counterclockwise in FIG. 2. This rotation causes tension coil spring 25 (not shown in FIG. 2) to extend and be charged in force while operating handle 35 rotates about connecting pin 24. When the acting line of force A crosses the line B connecting the center of connecting pin 24 and the center of shaft 20 from right to left, the tension of tension coil spring 25 is automatically discharged. In response, handle lever 17 rotates counterclockwise to come into contact with shaft 15, whereby its rotation is stopped. First link 22 rotates clockwise, whereby a stopper pin 48 of first link 22 comes into contact with trip lever 18. As a result, the rotation of first link 22 is stopped. Following this rotation of first link 22, movable contact holder 19 rotates counterclockwise via second link 23. From the moment movable contact 6 comes into contact with stationary contact 5, movable contact holder 19 further rotates slightly against the action force of contact pressure spring 33. As a result, the ON state of FIGS. 1 and 4 is achieved. Here, operating handle 35 is at the ON position.

During the ON operation, block link 26 receives only the action force of spring 44 during the initial stage where actuating pin 28 is detached from engaging edge 29*a* of first hole 29 to come into contact with engaging edge 29*b*. At the latter stage of operation, engaging edge 29*b* is pushed by actuating pin 28, whereby block link 26 moves leftwards together with reset pin 27 that moves along in third hole 31. Therefore, the operation of handle lever 17 and other operating mechanism will not be obstructed by the operation of actuating pin 28, whose movement is not obstructed by the edge portion of first hole 29. At this stage, shaft 21 relatively moves within second hole 30. During this movement, shaft 21 only receives the action force of spring 44, and does not have its movement obstructed by block link 26. Following this movement, actuating pin 28 comes into contact with engaging edge 29*b* of first hole 29 by the action of spring 44. Shaft 21 is in contact with engaging edge 30*a* of second hole 30.

The OFF operation is performed by rotating operating handle 35 clockwise in FIG. 4. This rotation causes tension coil spring 25 to extend and be charged in force while operating handle 35 rotates about connecting pin 24. When the acting line of force A crosses line B connecting the center points of connecting pin 24 and shaft 20 from left to right, the tension of tension coil spring 25 is automatically discharged. As a result, handle lever 17 rotates clockwise automatically. In response, first link 22 rotates counterclockwise. Movable contact holder 19 rotates clockwise via second link 23, whereby the switching contacts open. When movable contact holder 19 comes into contact with shaft 15, the rotation of movable contact holder 19, second link 23 and first link 22 stops.

At the initial stage of the OFF operation, block link 26 just receives the action force of spring 44 until actuating pin 28 comes into contact with engaging edge 29*a* of first hole 29. At the latter stage of the operation, block link 26 moves rightwards together with reset pin 27 that moves along in third hole 31 as a result of engaging edge 29*a* being pushed by actuating pin 28. Therefore, the operation of the operating mechanism such as handle lever 17 will not be blocked by the operation of actuating pin 28 whose movement is not obstructed at the edge portion of first hole 29. The movement of block link 26 during the OFF operation provides the positive action of determining the position where handle lever 17 stops at the completion of the OFF operation. Shaft 21 that moves relatively within second hole 30 only receives the action force of spring 44 during this movement. Therefore, the operation of shaft 21 will not be obstructed by block link 26, i.e. by the edge of second hole 30. After the movement, the state of FIG. 2 is achieved.

A trip operation is realized by trip piece 41 rotating clockwise by an actuator not shown protruding in response to a trip signal output from an operating overcurrent tripping device 42 of FIG. 1, or by depressing a manual trip button 49. This rotation releases the engagement between engaging end 41*a* and engaging end 40*a*, whereby secondary hook 40 rotates clockwise. Also, the engagement between roller 47 and engaging end 39*b* is released, whereby primary hook 39 rotates clockwise. Furthermore, the engagement between engaging end 39*a* and engaging end 18*a* is released, whereby trip lever 18 rotates counterclockwise.

The counterclockwise rotation of trip lever 18 causes shaft 20 to rotate counterclockwise, whereby first link 22, connecting pin 24, and then second link 23 are sequentially moved upwards. In response to this movement of connecting pin 24, the acting line of force A of tension coil spring 25 is altered, and handle lever 17 rotates clockwise. In response to the movement of second link 23, movable contact holder 19 rotates clockwise until forming contact with shaft 15, whereby the switching contacts open. Second link 23 comes into contact with trip lever 18, whereby the rotation of second link 23, first link 22 and trip lever 18 stops.

In this state, handle lever 17 is still biased clockwise. However, the urge of actuating pin 28 against engaging edge 29*a* of first hole 29 causes block link 26 to move rightwards together with reset pin 27 that moves along in third hole 31. Reset pin 27 comes into contact with trip lever 18, whereby that rightwards movement and rotation of handle lever 17 both stop. Here, operating handle 35 is located at an intermediate position between the ON position and the OFF position. Primary hook 39, secondary hook 40 and trip piece 41 rotates back in the counterclockwise direction by the action of the return spring to achieve the state of FIG. 5.

During this trip operation, block link 26 only receives the action force of spring 44 at the initial stage until forming the contact between engaging edge 29*a* and actuating pin 28. At the latter stage of operation, engaging edge 29*a* is pushed by operation shaft 28, whereby block link 26 moves rightwards together with reset pin 27 that moves along in third hole 31. Therefore, the operation of the operating mechanism such as handle lever 17 will not be obstructed by resistance at the edge portion of first hole 29. The positive action of determining the position where handle lever 17 is to be stopped after the operation is provided. Shaft 21 moving relatively within second hole 30 only receives the action force of spring 44. The operation of shaft 21 will not be obstructed by block link 26, i.e. by the edge of second hole 30.

Figure 5:
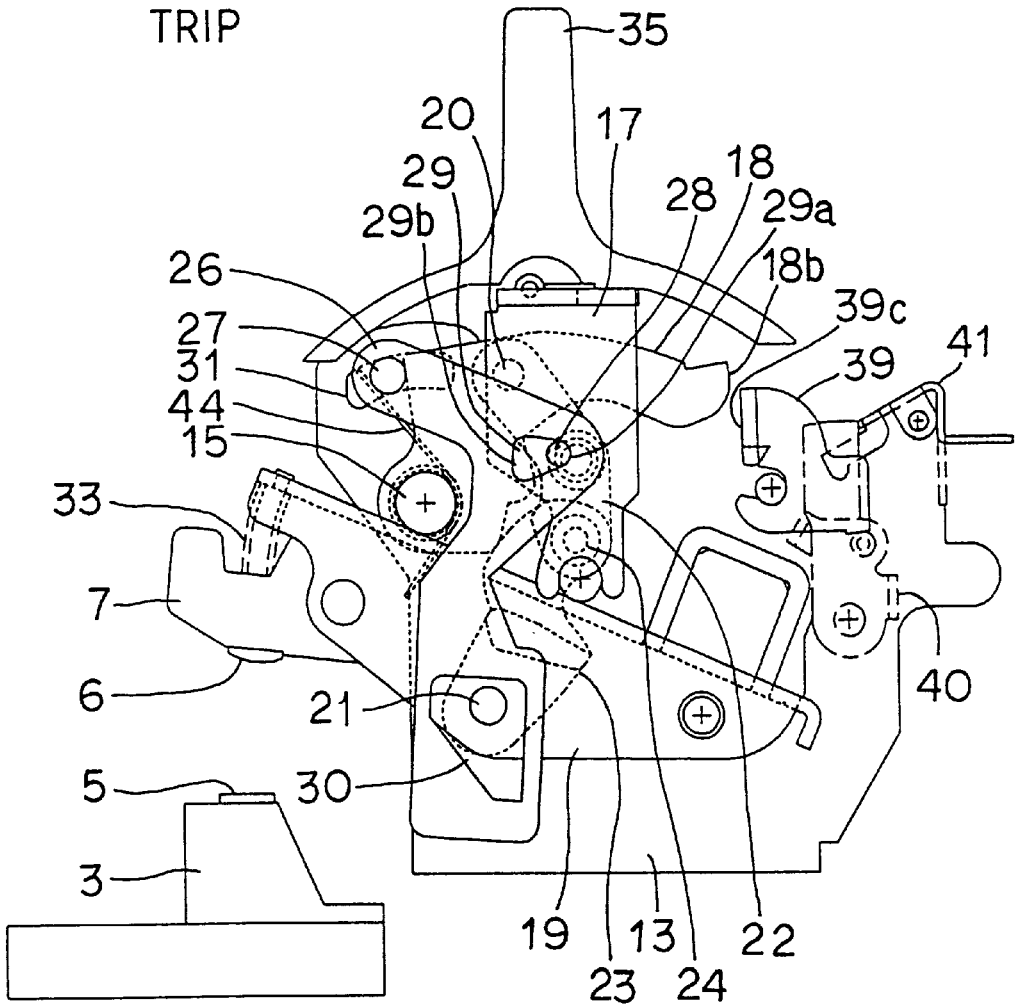
FIG. 5 is a side view of the main part of the circuit breaker of FIG. 1 in a trip state.
Figure 6:
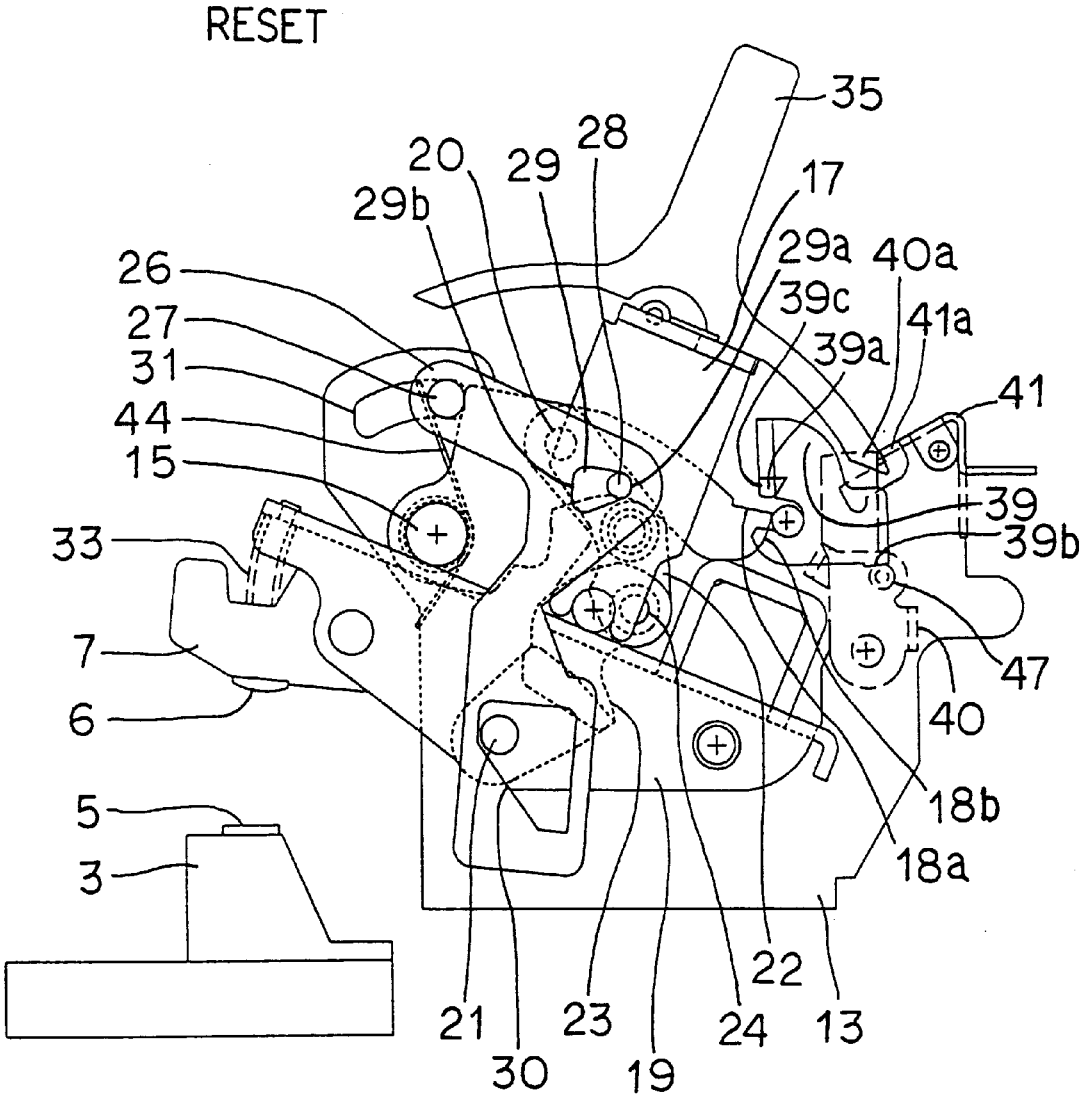
FIG. 6 is a side view of the main part of the circuit breaker of FIG. 1 in a reset operation.

In the state of FIG. 5, the reset operation is performed by rotating operating handle 35 clockwise. The rotation causes actuating pin 28 to push engaging edge 29*a* of first hole 29, whereby block link 26 is moved rightwards together with reset pin 27 that moves along in third hole 31. In response, reset pin 27 urges trip lever 18 to rotate clockwise. Reset edge 18*b* urges reset edge 39*c* to first rotate primary hook 39 clockwise. When the engagement of reset edge 18*b* and reset edge 39*c* is released as shown in FIG. 6, primary hook 39 rotates back in the counterclockwise direction. Then, by subsequently releasing one's hand from operating handle 35, trip lever 18 automatically rotates counterclockwise by the action of tension coil spring 25 (not shown in FIG. 5). Engagement between engaging end 18*a* and engaging end 39*a* is established to achieve the OFF state of FIG. 2.

During the reset operation, block link 26 only operates to provide the positive action to rotate trip lever 18 clockwise at the initial stage of operation and back to the OFF position in response to the rotation of trip lever 18 counterclockwise at the latter stage of operation. Therefore, the movement of the operating mechanism such as handle lever 17 will not be obstructed by the operation of actuating pin 28, whose movement is not obstructed by the edge portion of first hole 29. Shaft 21 moving relatively within second hole 30 only receives the action force of spring 44 during the movement. The operation of shaft 21 will not be obstructed by block link 29, i.e., by the edge of second hole 30.

In the reset operation, trip lever 18 can be rotated smoothly since reset pin 27 moves along a circular arc concentric with the rotation of trip lever 18. Therefore, no bigger operating force for the reset operation is required.

As described above, the circuit breaker of the present embodiment operates similarly to a conventional circuit breaker in the normal ON operation, OFF operation, trip operation and reset operation, provided that block link 26 determines the position of operating handle 35 at the OFF position and trip position, and that trip lever 18 is rotated by reset pin 27 that moves along a circular arc concentric with the rotation of trip lever 18 in the reset operation. Therefore, block link 26 will not provide any adverse affect on the manipulation and operation.

First hole 29 is set sufficiently larger than the diameter of actuating pin 28. A larger first hole 29 will increase the degree of freedom of block link 26 in the ON operation, the OFF operation and the trip operation to further ensure the manipulation and operation as long as the positioning action of handle lever 17at the OFF position and the action of reset pin 27 in the reset operation are exhibited without adversely affecting any other operation.

The operation of the circuit breaker attaining a trip operation to result in the weld of stationary contact 5 and movable contact 6 will be described with reference to FIG. 7. Also, the operation of operating handle 35 towards the OFF position from the state of FIG. 7 will be described with reference to FIG. 8.

When the switching contacts are welded in response to a trip operation in the ON state of FIG. 4, movable contact holder 19 will hardly rotate although biased clockwise. Accordingly, handle lever 17, trip lever 18, first link 22, second link 23, connecting pin 24 and the like exhibit almost no rotation or movement. Operating handle 35 substantially attains the ON position corresponding to the state of FIG. 7. At this stage, block link 26 receives the action force of spring 44, whereby engaging edge 29*b* of first hole 29 forms contact with actuating pin 28, and engaging edge 30*a* of second hole 30 forms contact with shaft 21.

Figure 8:
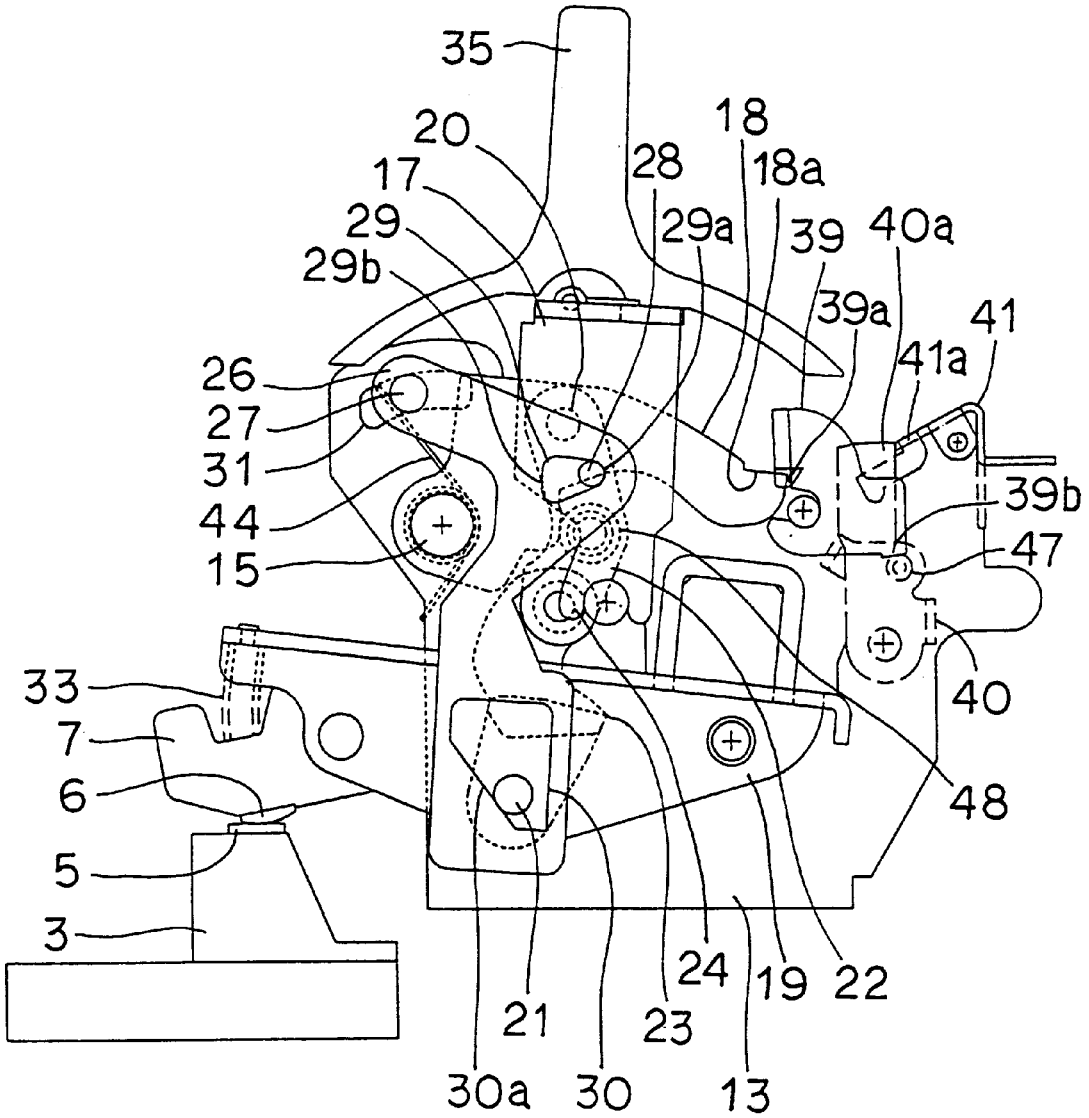
FIG. 8 shows the state when the operating handle is rotated towards the OFF operation under a welded state.

At the transition to the OFF operation from this welded state, actuating pin 28 moves clockwise as shown in FIG. 8. Operating handle 35 can be rotated clockwise upto the proximity of the trip position where engaging edge 29*a* of first hole 29 comes into contact. A further attempt of rotation thereof causes the OFF operating force to push block link 26 substantially rightwards via handle lever 17 and actuating pin 28.

This pushing force acts on shaft 21 via engaging edge 30*a* of second hole 30 in block link 26. However, block link 26 is obstructed of its rightwards movement since the displacement of shaft 21 is obstructed by the weld of the switching contacts. When handle lever 17 is further operated clockwise in the state where movement is obstructed at the portion of second hole 30, block link 26 is pushed to rotate substantially about the engaging point of engaging edge 30*a* and shaft 21 together with reset pin 27. However, since the center of the circular arc of third hole 31 guiding the movement of reset pin 27 differs from the center of rotation (engaging point between engaging edge 30*a* and shaft 21) of block link 26, reset pin 27 cannot move along the circular arc. As a result, the movement of reset pin 27 is obstructed. By these two obstruction works, the rightward movement of the entire block link 26 is obstructed. The rotation of handle lever 17 is also obstructed. Thus, operating handle 35 cannot be moved to the OFF position, let alone the reset position.

Figure 7:
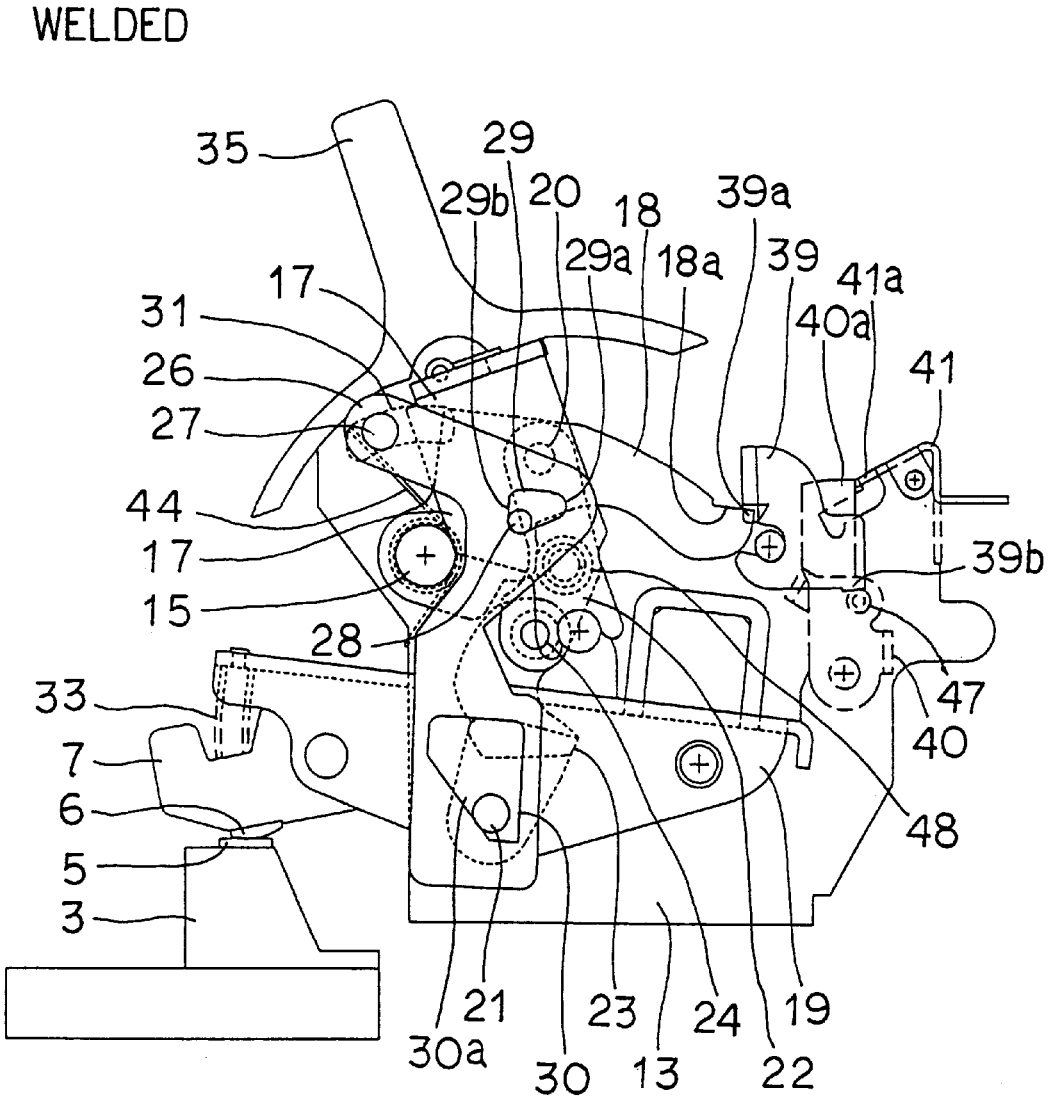
FIG. 7 is a side view of the main part of the circuit breaker of FIG. 1 in the state where the switching contacts are welded.

When one's hand is released from operating handle 35 in the state of FIG. 8 to provide a free state, operating handle 35 returns to the state of FIG. 7. In this OFF operation, the OFF operating force directly acts on shaft 21 dispensed with the spring. Engaging edge 30*a* is formed so that the action force causes movable contact holder 19 to be pushed clockwise. Therefore, the welded state can be removed, if the weld is not fixed firmly, by applying an intense OFF operating force. According to the present invention, the operating handle cannot arrive at the OFF position unless the welded state is removed. If the operating handle comes to the OFF position, the weld has been removed at an intermediate position during its passage to the OFF position.

Figure 9:
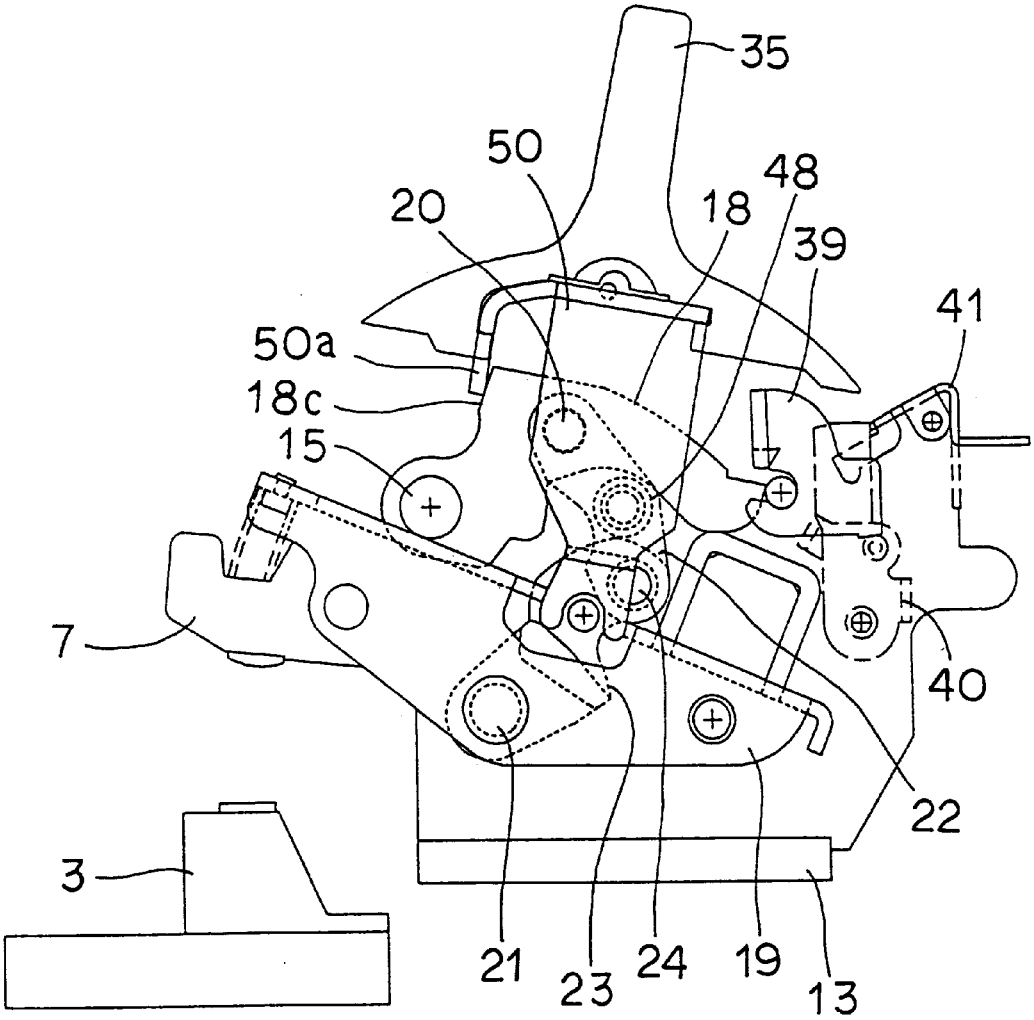
FIG. 9 is a side view of the main part of a conventional circuit breaker to describe a reset operation.

FIG. 9 shows a conventional circuit breaker corresponding to the inventive circuit breaker of the present invention shown in FIG. 6 to describe the reset operating force. The conventional circuit breaker has a conductor unit, an overcurrent tripping device, and an arc extinguishing device similar to those of the present embodiment. The basic structure of operating handle 35 of the operating mechanism, first link 22, second link 23, trip lever 18, tension coil spring 25, movable contact holder 19 and the like are similar to those of the present embodiment.

The conventional circuit breaker of FIG. 9 mainly differs from the circuit breaker of the present embodiment in that block link 26 is absent, and in the means of rotatably driving trip lever 18 in the reset operation. When operating handle 35 is rotated clockwise in the reset operation of the conventional circuit breaker of FIG. 9, a bent reset piece 50*a* of handle lever 50 urges a reset receiver portion 18*c* of trip lever 18 to rotate trip lever 18 clockwise. Since the center of rotation differs between reset piece 50*a* and reset receiver 18*c*, reset piece 50*a* slides along on reset receiver portion 18*c*. Great friction will occur in this slide, so that a great operating force is required in the reset operation.

In contrast to the conventional art, the center of the circular guide groove in which reset pin 27 moves is concentric with the center of rotation of trip lever 18 in the present embodiment. Therefore, the contact point between reset pin 27 and trip lever 18 does not move even when trip lever 18 is rotated. Since no friction force is generated, the force for the reset operating can be reduced than that of the conventional art. The guide groove does not necessary have to be a circular arc, through preferable.

In the above embodiment, second hole 30 is formed in the shape of a hole. However, the shape is not limited to a hole as long as an engaging end 30*a* is provided. Also, the shaft engaging with engaging edge 30*a* does not have to be shaft 21 pivotably supporting second link 23. Any element that establishes engagement with engaging end 30*a* of the contact holder or the movable contact that provides the above action for the OFF operation in the welded state can be employed. Furthermore, the relationship between first hole 29 of block link 26 and actuating pin 28 of handle lever 17 and the relationship between second hole 30 of block link 26 and shaft 21 of movable contact holder 19 may be relative. In other words, a first hole 29 can be formed in handle lever 17 and actuating pin 28 can be provided in block link 26.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circuit breaker including a movable contact device pivotally provided, having a movable contact holder pivotally holding a movable contact arm with one of a pair of switching contacts that opens and closes; a handle lever and a trip lever pivotally provided to a secured frame; an operating handle operating said handle lever; a pair of links coupled to each other by a connecting pin between said trip lever and said movable contact device; at least an operating spring provided between said connecting pin and said handle lever; latch means latching rotation of said trip lever biased by said operating spring; and reset means resetting said latch means released in its latch by rotating said handle lever, said circuit breaker having said operating spring extended to straighten said pair of links with each other for contacting said switching contacts when said handle lever is rotated in an ON direction, wherein said reset means comprises a reset driving member rotating said trip lever; guide means guiding movement of said reset driving member; and a reset link coupling said reset driving member and said handle lever.

2. The circuit breaker according to claim 1, wherein said guide means is formed along a circular arc having the center identical to the center of rotation of said trip lever.

3. The circuit breaker according to claim 1, wherein said guide means is a guide groove formed in said secured frame, said reset driving member is a reset pin fitted in said guide groove, said reset link has one end holding said reset pin and the other end connected to said handle lever by an actuating pin provided at one of said reset link and said handle lever and a hole provided at the other of said reset link and said handle lever, into which said actuating pin is fitted.

4. The circuit breaker according to claim 3, wherein said actuating pin and said hole that couple said reset link and said handle lever are fitted loosely with each other.

5. The circuit breaker according to claim 1, further comprising engaging means establishing engagement between said reset link and said movable contact device at an intermediate position of said handle lever in its passage to an OFF position when said handle lever is rotated towards the OFF position in a state where said switching contacts are welded, wherein said guide means obstructs movement of said reset driving member and prevents further rotation of said operating handle when said engagement is established.

6. The circuit breaker according to claim 5, wherein said engaging means of said reset link and said movable contact device includes a projection provided at one of said reset link and said movable contact device, and an engaging edge provided at the other of said reset link and said movable contact device.

7. The circuit breaker according to claim 6, wherein said projection provided at said movable contact device includes a shaft coupling said movable contact device with one of said pair of links.

8. The circuit breaker according to claim 5, wherein engagement is established between said reset link and said movable contact device at an angle in which an operating force of rotating said handle lever towards the OFF position at an engaging point between said reset link and said movable contact device pushes said movable contact device in a direction that causes said weld to be removed.

* * * * *